US005425315A

United States Patent [19]

Huggins

[11] Patent Number: 5,425,315

[45] Date of Patent: Jun. 20, 1995

[54] FOLDABLE TABLE

[76] Inventor: George M. Huggins, Rte. 1, Box 48, Blanchard, Okla. 73010

[21] Appl. No.: 36,514

[22] Filed: Mar. 24, 1993

[51] Int. Cl.[6] ..... A47B 3/00

[52] U.S. Cl. ..... 108/115; 108/128

[58] Field of Search ..... 108/115, 128, 66; 248/166, 434

[56] References Cited

U.S. PATENT DOCUMENTS

| | | | |
|---|---|---|---|
| 179,012 | 6/1876 | Graham . | |
| D. 204,391 | 4/1966 | Obayashi . | |
| 340,176 | 4/1886 | Wardwell, Jr. | 100/66 X |
| 473,534 | 4/1892 | Gilder | 108/128 X |
| 486,075 | 11/1892 | Benoit | 108/128 |
| 512,325 | 1/1894 | Reeves . | |
| 786,732 | 4/1905 | Crandall | 108/128 X |
| 901,904 | 10/1908 | Hutchinson | 108/128 |
| 1,226,554 | 5/1917 | Mante . | |
| 1,227,988 | 9/1918 | Miller . | |
| 1,571,129 | 1/1926 | Luckhoff | 108/128 X |
| 2,162,298 | 6/1939 | Dailey | 108/128 X |
| 2,445,489 | 7/1948 | Mangold . | |
| 2,560,079 | 7/1951 | Blum . | |
| 3,608,825 | 8/1972 | Sheldon | 108/66 X |
| 4,005,661 | 2/1977 | Mason et al. . | |

FOREIGN PATENT DOCUMENTS 373509 6/1922 Germany .

*Primary Examiner*—Jose V. Chen
*Attorney, Agent, or Firm*—Bill D. McCarthy

[57] ABSTRACT

An improved foldable table that opens and closes in an umbrella like fashion comprising a column member, a leg assembly, and a plurality of leaf members pivotally attached to the center column so as to be movable between an open position, wherein the leaf members mate to form a horizontal planar surface, and a closed position, wherein the table is easily stored and transported. The column member is selectively extendable and retractable, and the leg assembly is adapted to be selectively retracted into the column member. The center column includes a plurality of radial slots configured to matingly receive the leaf members when same are in either the open or closed position so that the leaf members remain in a selected radial plane. The leaf members include a selected fraction of supporting leaf members supported in the open position with a hinged bracket assembly and a selected fraction of regular leaf members disposed therebetween and supported in the open position with a beam hinge assembly that extends between the supporting leaf members. A cap member mounted over the center column is dimensioned to cooperate with the hinged bracket assembly and the beam hinge assembly to lock the leaf members in the horizontal planar position.

16 Claims, 4 Drawing Sheets

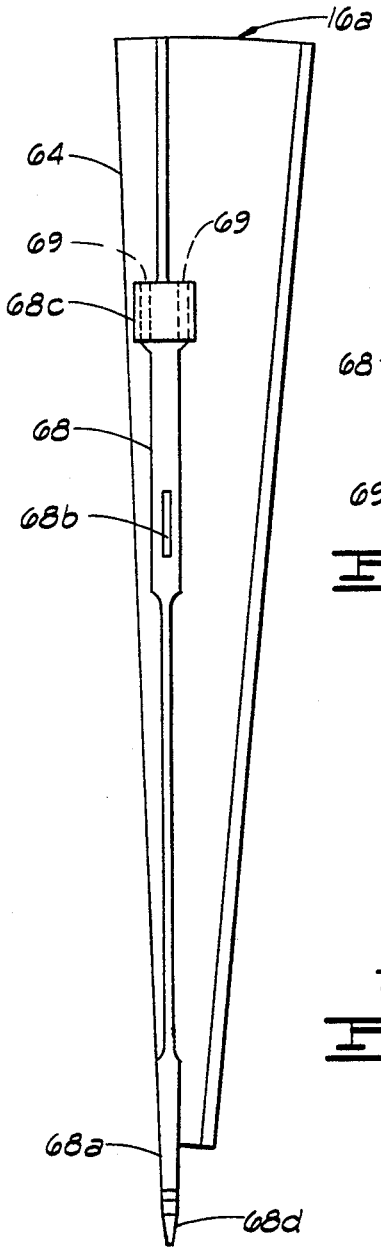
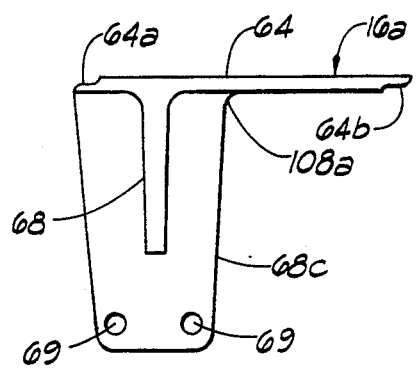
FIG. 5B
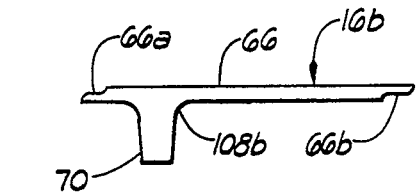
FIG. 5B
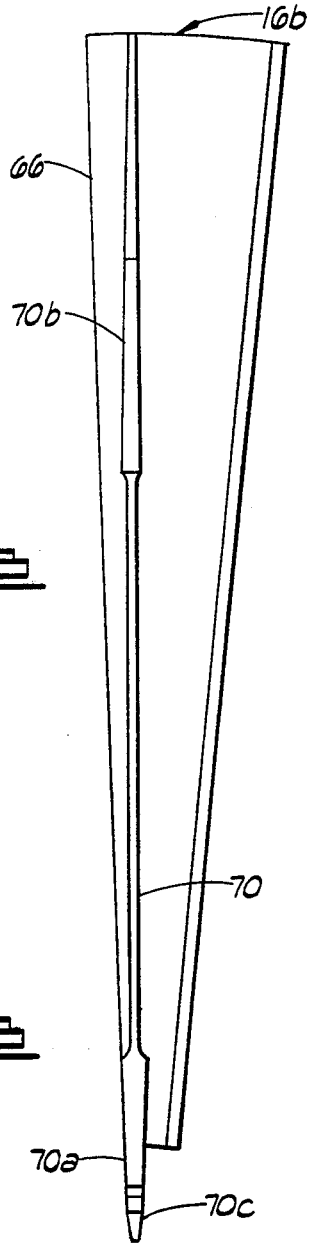
FIG. 5A
FIG. 5A
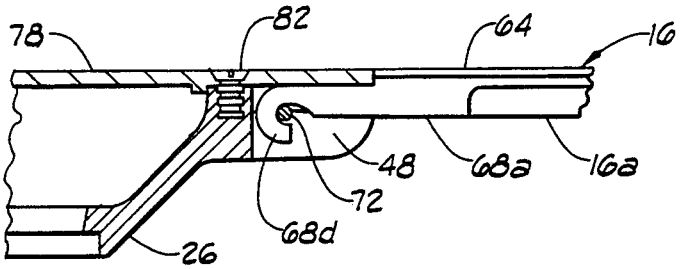
FIG. 7

FOLDABLE TABLE

BACKGROUND OF THE INVENTION

1. Field of the Invention.

The present invention relates to foldable furniture, and more particularly but not by limitation, to an improved table that opens and closes in an umbrella like fashion.

2. Brief Discussion of the Prior Art.

Campers, picnickers and the like often desire to take the comforts and conveniences of home with them on their outings. These conveniences often include furniture that can be readily set up and quickly transformed or folded into a small and compact structure which is easy to transport and store.

To this end, folding tables have long been known in the art and have been designed to fold in many different manners. For example, a common folding table design is one in which the legs of the table individually fold into the plane of the table top. While this design does in fact reduce the overall volume of the table, the table top may still be too large or awkwardly shaped to make handling and storage of the table convenient.

In order to reduce a table to an even more compact structure, and thus alleviate the problem mentioned above, a design that allows the table to open and close in an umbrella like fashion is employed. In general, this type of design permits the legs of the table to be folded up or retracted and the table top collapsed to a diameter that makes the table easy to carry or transport and convenient to store in a small space.

Several prior art umbrella like tables have been proposed. However, the prior art umbrella like tables have generally not met with much success because of design deficiencies which have resulted in overly complex structures that are uneconomical to manufacture and inconvenient to use. In particular, the table disclosed in U.S. Pat. No. 4,005,661, issued to Mason et al., is difficult to set up and take down as a result of several design deficiencies, such as its leg assembly and the configurations of its central plate and leaf members. More specifically, the design of the leg assembly is such that it is unstable and awkward to manipulate, and the configurations of the leaf members and the central plate are such that the leaf members do not adequately mate with the central plate to enable the leaf members to open and close smoothly and efficiently. That is, the configurations of the central plate and the leaf members permit lateral movement of the leaf members within radial slots formed in the central plate, thus disrupting the radial alignment of the leaf members.

Another problem associated with the table of the Mason et al. patent is that the leaf members are not securely locked in place when in the open position. Thus, the leaf members are able to rotate past the horizontal plane of the table top in much the same way as when an umbrella is extended beyond its normal operating position by a strong gust of wind. Obviously, an umbrella that is easily blown open is not very useful; likewise, a table that does not provide a flat and stable surface is of little use.

Thus, the present invention relates to a foldable table which overcomes the deficiencies of the prior art tables. That is, the present invention is directed to an improved foldable table that is easy to set up, easy to store and easy to transport, while also being relatively inexpensive to manufacture.

SUMMARY OF THE INVENTION

According to the present invention an improved foldable table is provided that opens and closes in an umbrella like fashion. The improved foldable table comprises a column member, a leg assembly, and a plurality of leaf members pivotally attached to the center column so as to be movable between an open position (wherein the leaf members mate to form a horizontal planar surface) and a closed position (wherein the table is easily stored and transported). The column member is selectively extendable and retractable to accommodate both children and adults, and the leg assembly is adapted to be selectively retractable into, and extendable from, the column member. The center column includes a leaf support member having a plurality of radial slots configured to matingly receive the leaf members when same are in either the open or closed position so that the leaf members remain in selected radial planes.

The leaf members include a selected fraction of supporting leaf members supported in the open position with a hinged bracket assembly and a selected fraction of regular leaf members disposed therebetween and supported in the open position with a beam hinge assembly that extends between the supporting leaf members. To secure the leaf members in a horizontal planar position when the leaf members are in the open position, a cap member is mounted over the leaf support member. The cap member is configured so that it cooperates with the hinged bracket assembly and the beam hinge assembly to lock the leaf members in the horizontal planar position.

An object of the present invention is to provide an improved foldable table that smoothly opens and closes in an umbrella like fashion.

Another object of the present invention, while achieving the above stated object, is to provide an improved foldable table that is easy to set up, easy to store and easy to transport.

Another object of the present invention, while achieving the above stated objects, is to provide an improved foldable table which is convenient to use, durable in construction and economical to manufacture.

Other objects, features and advantages of the present invention will become apparent from the following detailed description when read in conjunction with the drawings and appended claims.

BRIEF DESCRIPTION OF THE DRAWINGS

FIG. 5A is bottom plan view of a supporting leaf member. FIG. 5B is a front elevational view of a supporting leaf member.

FIG. 6A is bottom plan view of a regular leaf member. FIG. 6B is a front elevational view of a regular leaf member.

FIG. 7 is a fragmental, cross-sectional view of the leaf support member, the cap member and a leaf member illustrating the leaf member locked in the open position.

DETAILED DESCRIPTION

Figure 1:
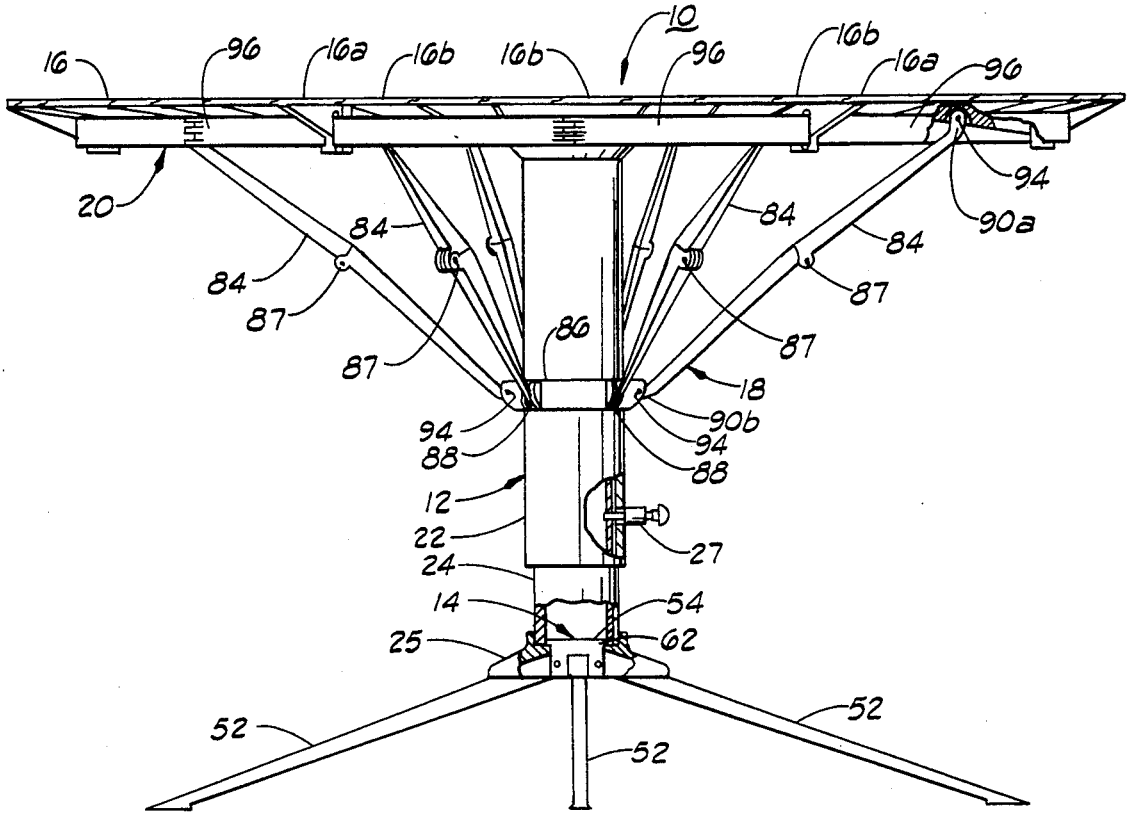
FIG. 1 is a side elevational view of a foldable table construted in accordance with the present invention illustrated in an open position.
Figure 2:
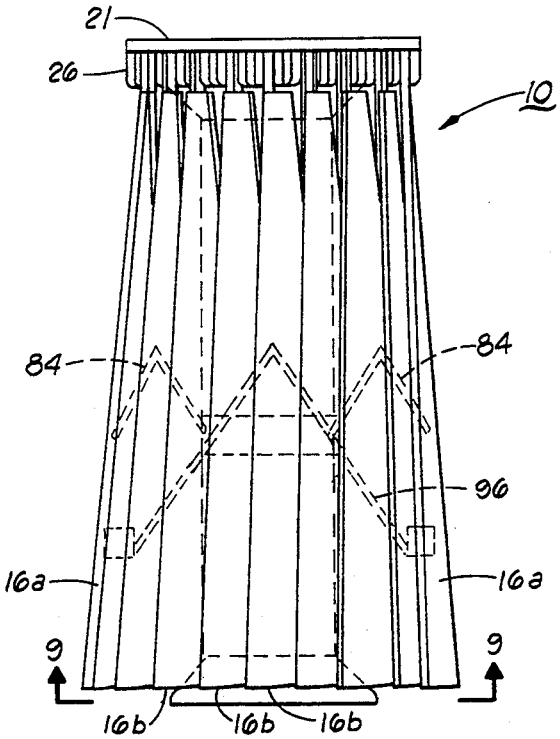
FIG. 2 is a side elevational view of the foldable table of FIG. 1 illustrated in a closed position.

Referring now to the drawings, and more particularly to FIGS. 1 and 2, a table 10 constructed in accordance with the present invention is illustrated in an open position and a closed position, respectively. The unique design features of the table 10, which will be described in detail hereinbelow, overcome the inherent deficiencies of the prior art tables; and thus the table 10 represents an advance in the state of the art relating to foldable tables.

The table 10 comprises a center column 12, a leg assembly 14, and a plurality of leaf members 16 which include a plurality of supporting leaf members 16*a* and a plurality of regular leaf members 16*b*. The supporting leaf members 16*a* are similar in constructing to the regular leaf members 16*b*, with the differences therebetween to be described hereinbelow. The leaf members 16 are movable between the open position (FIG. 1), wherein they mate to form a horizontal planar surface, and the closed position (FIG. 2) wherein they collapse to a diameter that allows the table 10 to be easily stored and transported. The table 10 further comprises a hinged bracket assembly 18, a beam hinge assembly 20 and a cap member 21 (FIG. 2) which cooperate to lock the leaf members 16 in a horizontal planar position when in the open position.

The table 10 can be constructed of any suitable material; however, one of the advantages of the present invention is that the table 10 is particularly well suited to be constructed of a polycarbonate material, thereby resulting in a light weight, yet durable structure. Thus, for purposes of this disclosure, it will be understood that the components of the table 10 are preferably constructed of a polycarbonate material, unless otherwise stated herein.

Figure 3:
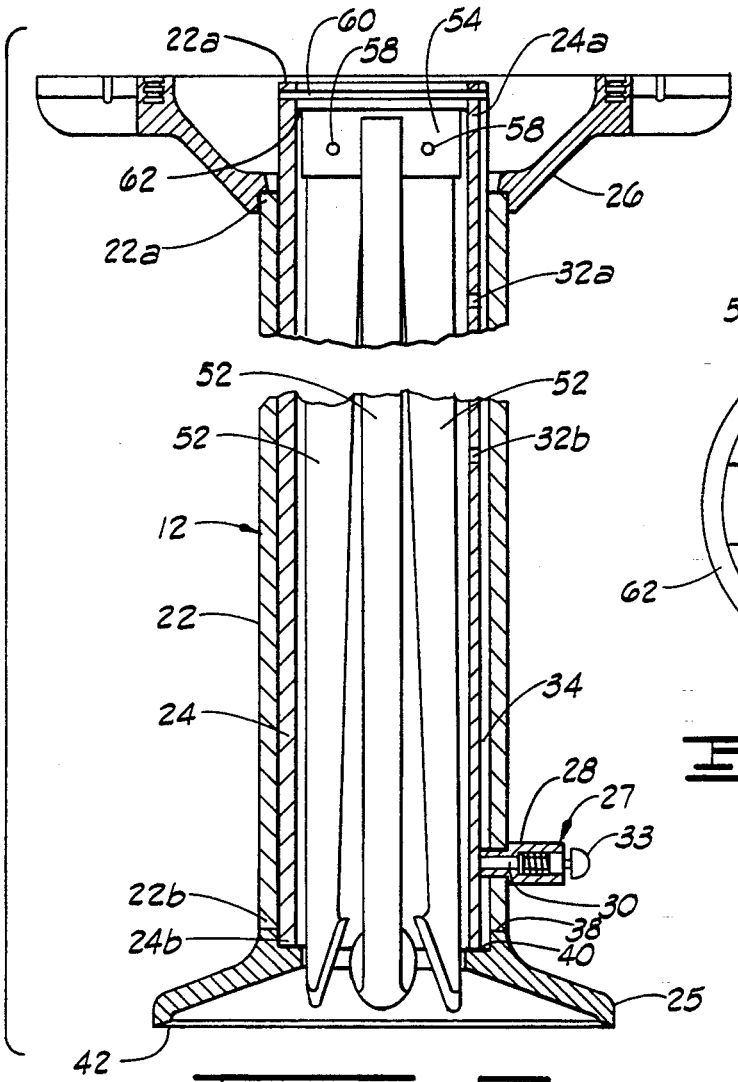
FIG. 3 is a partially cutaway, cross-sectional view of a center column and a leg assembly of the present invention, wherein the leg assembly is illustrated in a retracted position.

Referring now to FIG. 3, the center column 12 comprises an outer tube 22 and an inner tube 24, a leg support member 25 and a leaf support member 26. The outer and inner tubes 22, 24 are each characterized as having a top end 22*a*, 24*a* and a bottom end 22*b*, 24*b*. The inner tube 24 is telescopingly disposed in the outer tube 22 so that the height of the table 10 can be readily adjusted to accommodate people ranging in size from small children to adults. A plunger assembly 27 is employed to support the outer tube 22 in a selected extended position relative to the inner tube 24. The plunger assembly 27 includes a housing 28 disposed in the outer tube 22 and a spring-loaded plunger 30 selectively insertable into a pair of holes 32*a*, 32*b* disposed through the inner tube 24. Because of the stress applied to the housing 28 and the plunger 30 during use of the table 10, the housing 28 and the plunger 30 are preferably constructed of steel.

The holes 32*a*, 32*b* are dimensioned to supportingly receive the plunger 30, and the holes 32*a*, 32*b* are selectively spaced apart from one another so that the table 10 can be adjusted to a desired height. To this end, center column 12 is dimensioned so that the table 10 is well suited for use by young children when the outer and inner tubes 22, 24 are in a collapsed position relative to one another (FIG. 3), and suited for use by older children and adults when the outer tube 22 is supported in an extended position relative to the inner tube 24 (FIG. 1). The center column 12 is maintained in a selectively extendable position by inserting the plunger 30 into the appropriate hole 32*a*, 32*b*. While only two holes are shown herein, it is obvious that more holes can be positioned along the length of the inner tube 24 if desired.

The height of the table 10 is adjusted by pulling a knob 33 provided on the end of the plunger 30 to release the plunger 30 from the holes 32*a*, 32*b*. To facilitate changing the height of the table 10, the inner tube 24 is provided with a slot 34, extending the length of the inner tube 24, that guides the plunger 30 to the desired hole 32*a*, 32*b* as the center column 12 is either extended or collapsed.

The leg support member 25 is connected to the bottom end 24*b* of the inner tube 24 and is configured to cooperate with the leg assembly 14 to support the center column 12 in a manner to be described hereinbelow. The leg support member 25 is a hollow member with a flared end and an external support shoulder 38. The external support shoulder 38 abuts the bottom end 22*b* of the outer tube 22 when the outer and inner tubes 22, 24 are collapsed relative to one another as shown in FIG. 3. The leg support member 25 is further provided with an internal support shoulder 40 and a support rim 42, both of which operate in conjunction with the leg assembly 14 to support the center column 12 as will be described hereinbelow.

Figure 3A:
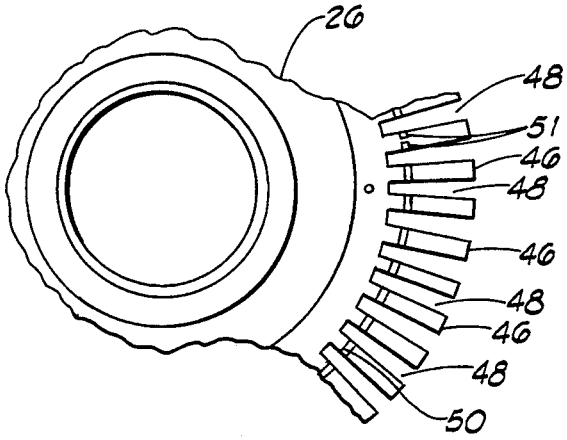
FIG. 3A is a fragmental, top plan view of a leaf support member of the present invention.

The leaf support member 26 is connected to the top end 22*a* of the outer tube 22. As best illustrated in FIG. 3A, the leaf support member 26 is provided with a plurality of equally spaced radial fingers 46 formed along the periphery thereof. The radial fingers 46 define a plurality of radial slots 48 in which the leaf members 16 are to be pivotally positioned as described hereinbelow. A retaining ring receiving groove 50, used for securing the leaf members 16 in the radial slots 48, is formed across the top of the radial fingers 46 about the center leaf support member 26. The retaining ring receiving groove 50 is provided with terminal ends 51 within one of the radial fingers 46. As mentioned, the manner in which the leaf members 16 are secured in the radial slots 48 will be described in detail hereinbelow.

Figure 4:
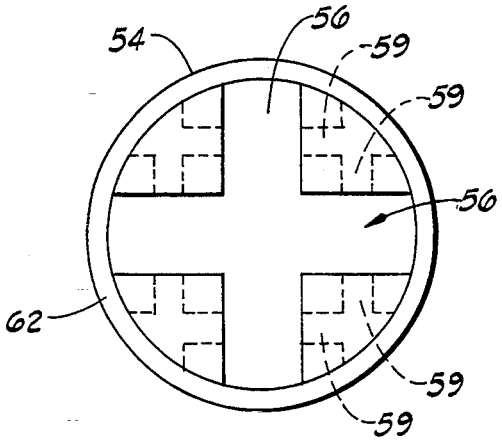
FIG. 4 is a bottom plan view of a leg pivot member of the present invention having the legs removed therefrom for purposes of clarity.

The leg assembly 14 preferably includes four legs 52 (only three of which are shown) pivotally connected to a leg pivot member 54. FIG. 4 is a bottom plan view of the leg pivot member 54 without the legs 52 attached thereto, illustrating the leg pivot member 54 as a cylindrical-shaped member having a pair of crisscrossing leg receiving slots 56 formed therethrough which are dimensioned to pivotally receive one end of the legs 52. The legs 52 are pivotally secured in the leg receiving slots 56 with roll pins 58 (FIG. 3) which are disposed in pin receiving holes 59 (FIG. 4).

The leg pivot member 54 is slidably disposed in the inner tube 24 so that the legs 52 are selectively retractable into the inner tube 24, as shown in FIG. 3, or outwardly extendable from the bottom end 24*b* of the inner tube 24, as shown in FIG. 1. A retaining pin 60 is traversely disposed through the top end 24*a* of the inner tube 24 to prevent the leg assembly 14 from sliding through the top end 24*a* of the inner tube 24. The leg pivot member 54 is supported at the bottom end 24*b* of the inner tube 24 by providing the leg pivot member 54 with an external support shoulder 62 which supportingly engages the internal support shoulder 40 of the leg support member 25 when the legs 52 are outwardly extended, as shown in FIG. 1.

When use of the table 10 is desired, the legs 52 are pulled from the bottom end 24*b* of the inner tube 24 until the external support shoulder 62 of the leg pivot member 54 engages the internal support shoulder 40 of the leg support member 25. The legs 52 are then extended outwardly until they engage the support rim 42 of the leg support member 25. The support rim 42 is angled inwardly to provide a conformable surface between the support rim 42 and the legs 52. The legs 52 can be secured to the ground, if desired, with a plurality of U-shaped stakes or staples (not shown) or other such suitable device.

As previously stated, the top of the table 10 is made up of the leaf members 16 which include a plurality of supporting leaf members 16*a* and a plurality of regular leaf members 16*b*. It is preferable for the leaf members 16 to include six supporting leaf members 16*a* equally spaced about the leaf support member 44 and forty-two regular leaf members 16*b* disposed therebetween. FIGS. 5A and 5B depict one of the supporting leaf members 16*a*, and FIGS. 6A and 6B depict one of the regular leaf members 16*b*. Each of the supporting leaf members 16*a* comprises a segmental portion 64 having arcuate longitudinal edges 64*a* and 64*b*, and each of the regular leaf members 16*b* comprises a segmental portion 66 having arcuate longitudinal edges 66a and 66b. The segmental portions 64 and 66 of the supporting leaf members 16*a* and the regular leaf members 16*b*, respectively, are identical in construction, and the edges 64*a*, 64*b* of the supporting leaf members 16*a* and the edges 66a, 66b of the regular leaf members 16*b* are arcuately configured as substantially shown in FIGS. 5B and 6B. That is, the edges 64*a*, 64*b* and 66*a*, 66*b* are configured so as to be mateable with the opposing edge of the adjacent leaf member 16 when the leaf members 16 are in the open position, thereby forming a contiguous horizontal planar surface as shown in FIG. 1. The arcuate configuration of the edges 66*a*, 66*b* allow the leaf members 16 to slide over the adjacent leaf member 16 as the leaf members 16 are moved to the closed position.

The supporting leaf members 16*a* further comprise a support rib 68 having a wedge-shaped end portion 68*a* configured to be matingly received in the radial slots 48 of the leaf support member 44. The support rib 68 is integrally formed along the bottom side of the segmental portion 64 of the supporting leaf member 16*a* so that the wedge-shaped end portion 68*a* extends past the segmental portion 64. The support rib 68 is further provided with a longitudinally oriented slot 68*b* and an enlarged distal end portion 68*c* having a pair of hinge pin receiving holes 69 longitudinally disposed therethrough, each of which are utilized to support the supporting leaf members 16*a* as will be described hereinbelow.

The regular leaf members 16*b* further comprise a support rib 70 having a wedge-shaped end portion 70*a* identical in configuration to the wedge-shaped end portion 68*a* of the supporting leaf member 16*a* so as to be mateable with radial slots 48 of the leaf support member 44. The support rib 70 is intregally formed along the bottom side of the segmental portion 66 of the regular leaf members 16*b* so that the wedge-shaped end portion 70*a* extends past the segmental portion 66. The support rib 70 is further provided with an enlarged portion 70*b* which is utilized to support the regular leaf members 16*b* as described hereinbelow.

In order to pivotally secure the leaf members 16 in the radial slots 48 of the leaf support member 44, each of the wedge-shaped end portion 68*a*, 70*a* of the supporting leaf members 16*a* and the regular leaf members 16*b* have a hooked portion 68*d* and 70*c*, respectively. The configuration of the hooked portions 68*d*, 70*c* is depicted in FIG. 7. Because of the wedge-shaped end portions 68*a*, 70*a* are identical in configuration, only one of the leaf members 16 is shown with reference to FIG. 7. However, it should be understood that the configuration of the hooked portion 68*d* of the supporting leaf members 16*a* and the hooked portion 70*c* of the regular leaf members 16*b* are identical in configuration.

As shown in FIGS. 5A and 6A, the hooked portions 68*d* and 70*c* of the supporting leaf members 16*a* and the regular leaf members 16*b* are tapered. This tapered configuration of the hooked portions 68*d* and 70*c* facilitates pivotation of the leaf members 16 between the open and closed positions when the leaf members 16 are secured in the radial slots 48 of the leaf support member 44.

As illustrated in FIG. 7, the leaf members 16 are pivotally supported in the radial slots 48 of the leaf support member 44 with a retaining ring 72. The retaining ring 72 is split and disposed in the retaining ring receiving groove 50 such that the ends of the split retaining ring 72 abut the terminal ends 51 of the retaining ring receiving groove 50, thereby securing the retaining ring 72 in place. When disposed in the retaining ring receiving groove 50, the retaining ring 72 traverses each of the radial slots 48 of the leaf support members 44, thus allowing each of the leaf members 16 to be supported in the radial slots 48 by hooking the leaf members 16 onto the retaining ring 72.

When all the leaf members 16 are hooked onto the retaining ring 72, a cap member 78 is mounted over the leaf support member 26 to secure the retaining ring 72 and the leaf members 16 in place. The cap member 78 is circular-shaped and dimensioned so that it mates with the segmental portions 64 and 66 and the support ribs 68, 70 of the leaf members 16 when same are in the open position to prevent the leaf members 16 from rotating beyond a horizontal planar position. The cap member 78 also serves as the center portion of the top of the table 10. The cap member 78 is secured to the center leaf support member 44 in a suitable manner, such as with a plurality of screws 82.

Figure 3B:
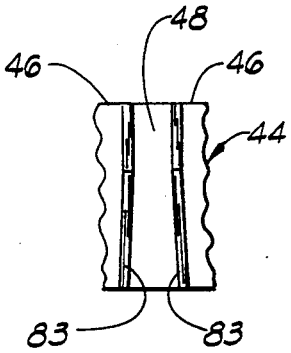
FIG. 3B is a fragmental, side elevational view of a radial slot of the leaf support member.

To assure that the table 10 opens and closes easily and smoothly, the leaf members 16 must remain within a designated radial plane so that each of the leaf members 16 rotate between the open and closed positions unimpeded by the adjacent leaf members 16. To this end, a lower portion 83 (FIG. 3B) of the radial fingers 46 of the leaf support member 44 is beveled such that the radial slots 48 are geometrically configured to matingly receive the wedge-shaped end portions 68*a*, 70*a* when the leaf members 16 are in either the open position or the closed position. That is, the vertical profile of the lower portion 83 of the radial slots 48 is substantially identical in configuration to the horizontal profile, thus resulting in the wedge-shaped end portions 68*a*, 70*a* being matingly disposed between, and thereby laterally supported by, the radial fingers 46 when the leaf members 16 are in either the open or closed position so that the leaf members 16 are unable to laterally shift from their designated radial plane.

Referring again to FIG. 1, the supporting leaf members 16*a* are horizontally supported in the open position by the hinged bracket assembly 18. The hinged bracket assembly 18 includes six hinged brackets 84 and a collar 86. The collar 86, having six equally spaced vertical slots 88 formed thereon, is mounted about the outer tube 22 so that the slots 88 are in the vertical plane of the slots 68*b* of the support ribs 68 of the supporting leaf members 16*a*. Each of the hinged brackets 84 are constructed to pivot about a point 87 such that the hinged brackets 84 are extendable as shown in FIG. 1 and collapsible as shown in FIG. 2.

Each of hinged brackets 84 have a first end 90*a* and a second end 90*b*. The first end 90*a* of each of the hinged brackets 84 is pivotally connected to one of the supporting leaf members 16*a* and the second end 90*b* of each of the hinged brackets 84 is pivotally connected to the collar 86. That is, the first end 90*a* of the hinged brackets 84 is adapted to be pivotally disposed in the slot 68B of the supporting leaf members 16*a*, and the second end 90*b* of the hinge brackets 84 is adapted to be pivotally disposed in the vertical slots 88 of the collar 86. The first and second ends 90*a*, 90*b* are secured in the slots 68*b* and 88, respectively, with a pivot pin 94 constructed of a metal material, such as steel. Thus, the hinged brackets 84 horizontally support the supporting leaf members 16*a* when same are in the open position, while permitting one to move the supporting leaf members 16*a* to the closed position by collapsing the hinged brackets 84 inwardly.

The regular leaf members 16*b* are horizontally supported in the open position by the beam hinge assembly 20. The beam hinge assembly 20 includes six beam hinges 96 (only three shown in FIG. 1), wherein one beam hinge 96 is pivotally supported between each pair of adjacent supporting leaf members 16*a*. The beam hinges 96, characterized as having oppositely disposed ends, are made up so that they fully extend between the supporting leaf members 16*a* when the supporting leaf members 16*a* are in the open position (FIG. 1), and collapse inwardly in relation to the leaf members 16 when the supporting leaf members 16*a* are moved to the closed position (FIG. 2).

As will be understood by those of ordinary skill in the art, the beam hinges 96 must be attached to the supporting leaf members 16*a* in such a manner that allows the ends of the beam hinges 96 to rotate about perpendicular axes as the supporting leaf members 16*a* are moved between the open and closed positions. The prior art tables have utilized multiple part, double hinged structures which greatly increase the parts count of the table 10, and thus the cost of manufacturing. To this end, FIG. 8 best illustrates the use of an L-shaped hinge pin 98 of unitary construction to effect such rotation.

The hinge pin 98 has a first hinge portion 98*a*, a second hinge portion 98*b* and an enlarged elbow portion 98*c*. The first hinge portion 98*a* of the hinge pin 98 is pivotally connected at one end of the beam hinges 96, and the second hinge portion 98*b* is pivotally disposed through one of the hinge pin receiving holes 69 of the supporting leaf members 16*a* such that the ends of the beam hinges 96 are supported in oppositely disposed hinge pin receiving holes 69 of adjacent supporting leaf members 16*a*. The enlarged elbow portion 98*c* of the hinge pin 98 abuts the beam hinge 96 and the enlarged distal end portion 68*c* of the supporting leaf members 16*a* when the hinge pin 98 is secured in place. The first hinge portion 98*a* is pivotally connected at the end of the beam hinge 96 by disposing the first hinge portion 98*a* through a bore (not shown) provided in the ends of the beam hinges 96 and securing the first hinge portion 98*a* with a hinge pin cap (not shown) which bonded to the end of the first hinge portion 98*a* so as to permit the ends of the hinge beams 96 to freely rotate about the first hinge portion 98*a*. The second hinge portion 98*b* is secured in the hinge pin receiving holes 69 of the supporting leaf members 16*a* in an identical manner.

As depicted in FIG. 1, the regular leaf members 16*b* rest on the beam hinges 96 at the enlarged portion 70*b* of the support rib 70 when in the open position. Thus, the support ribs 70 of the regular leaf members 16*b* are dimensioned so that the segmental portions 64 and 66 of the leaf members 16 are coplanar when the supporting leaf members 16*a* are supported by the hinged bracket assembly 18 and the regular leaf members 16*b* rest on the beam hinges 96.

Figure 8:
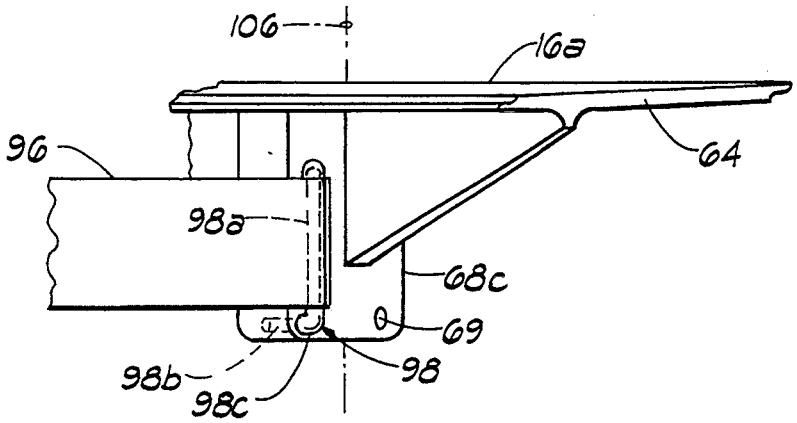
FIG. 8 is a fragmental, perspective view of a supporting leaf member showing the connection of a hinged beam thereto with an L-shaped hinge pin.
Figure 9:
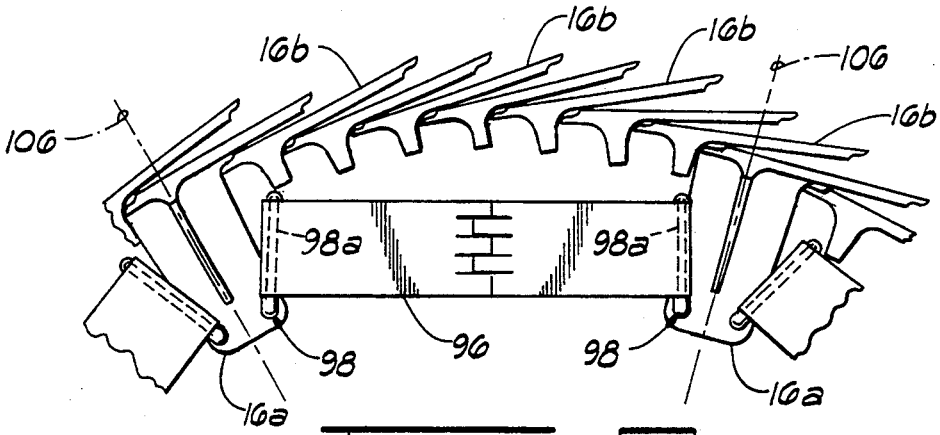
FIG. 9 is a fragmental bottom plan view taken at 9—9 in FIG. 2.
Figure 10:
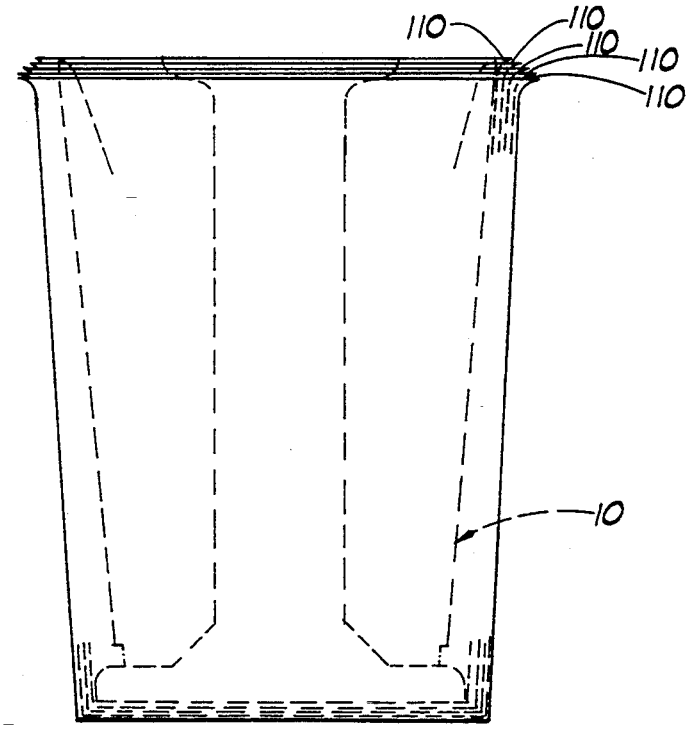
FIG. 10 is a side elevational view of a plurality of cylindrical stools nested together with the foldable table of the present invention invertedly disposed therein.

FIGS. 2 and 9, more clearly illustrate the manner in which the beam hinges 96 pivot in relation to adjacent supporting leaf members 16*a* as the supporting leaf members 16*a* are moved to the closed position. FIG. 2 shows the beam hinge 96 pivoted inwardly with the ends of the beam hinge 96 having pivoted about the first hinge portion 98*a*. FIG. 9 (taken at 9—9 of FIG. 2) illustrates the inward rotation of the beam hinge 96 with respect to the support rib 68 of the supporting leaf members 16*a*. This is explained by the fact that when the supporting leaf members 16*a* are in the open position, the end of the beam hinges 96 are parallel to vertical axis 106 of the supporting leaf members 16*a* as shown in FIG. 8. However, when the supporting leaf members 16*a* are moved from the open position, axis 106 of the supporting leaf members 16*a* becomes a radial axis. Therefore, the ends of the beam hinges 96 must rotate inwardly in relation to the adjacent supporting leaf members 16*a* as shown in FIG. 9.

FIG. 9 further illustrates the manner in which the leaf members 16 overlap and nest with one another when in the closed position. As indicated in FIGS. 5B and 6B, the support rib 68 of the supporting leaf members 16*a* and the support rib 70 of the regular leaf members 16*b* are provided with a longitudinal arcuate surface 108*a* and 108*b*, respectively, along the base of the support ribs 68 and 70 which is configured to matingly receive the arcuate edge 64*a* or 66*a* of the adjacent leaf members 16.

FIG. 8 shows a plurality of substantially cylindrical stools 110 nested together with the table 10 disposed therein. The stools 110 are dimensioned such that the table 10 can be disposed, and thereby stored, within the inner-most stool 110 when the table 10 is in the closed position and inverted. When using the table 10, the stools 110 can be turned over and used as sitting devices in combination with the table 10.

It is clear that the present invention is well adapted to carry out the objects and to obtain the ends and advantages mentioned as well as those inherent therein. While a presently preferred embodiment of the invention has been described for purposes of this disclosure, it will be recognized that numerous changes may be made which will readily suggest themselves to those skilled in the art and which are encompassed within the spirit of the invention disclosed and as defined in the appended claims.

What is claimed:

1. A foldable table, comprising:

a center column having a top end and a bottom end, the top end having a plurality of equally spaced radial fingers extending therefrom such that a plurality of radial slots are defined therebetween;

leg means for vertically supporting the center column;

a plurality of leaf members including a plurality of supporting leaf members equally spaced about the center column and a plurality of regular leaf members positioned therebetween, each leaf member comprising:

a segmental portion;

a support rib, integrally formed along bottom or side of the segmental portion, having a wedge-shaped end portion pivotally secured in one of the radial slots of the center column so as to permit movement of the leaf member between an open position, wherein the segmental portions of the leaf members mate to form a horizontal planar surface, and a closed position wherein the leaf members slidably overlap one another; and wherein the radial slots of the center column are configured to matingly receive the wedge-shaped end portion of the support ribs when the leaf member are in either one of the open position and the closed position so as to maintain the leaf members in a designated radial plane, and wherein the supporting leaf members have an enlarged distal end portion with a pair of hinge pin receiving holes longitudinal disposed therethough;

hinged bracket means having a first end pivotally connected to the supporting leaf members and a second end pivotally connected to the center column for supporting the supporting leaf members in the open position;

beam hinge means for horizontally supporting the regular leaf members in the open position, the beam hinge means comprising:

a plurality of beam hinges each having oppositely disposed ends pivotally attached to adjacent supporting leaf member; and a plurality of L-shaped hinge pins each having a first hinge portion pivotally connected at one of the ends of the beam hinge and a second hinge portion pivotally disposed through one of the hinge pin receiving holes of the supporting leaf members such that the beam hinges are pivotally attached to adjacent supporting leaf members so that the ends of the beam hinges are rotatable about perpendicular axes as the supporting leaf members are moved to and from open position; and a cap member mounted on the center column and adapted to mate with the leaf members when same are in the open position so as to cooperate with the hinged bracket means and the beam hinge means to lock the leaf members in a horizontal planar position, 2. The foldable table of claim 1 wherein the segmental portion of the leaf members has a pair of arcuate longitudinal edges configured to allow the leaf members to slide over one of the adjacent leaf members when the leaf members are moved from the open position.

3. The foldable table of claim 2 wherein the leaf members are provided with a longitudinal arcuate surface along the base of the support rib which is mateable with the oppositely disposed arcuate edge of the adjacent leaf member so that the leaf members nest against one another when in the closed position.

4. The foldable table of claim 1 wherein the center column is tubular and provided with an internal support shoulder at the bottom end thereof, and wherein the leg means comprises:

a leg pivot member slidably disposed in the center column having an external support shoulder; and at least three legs pivotally attached to the leg pivot member such that the legs are selectively retractable and outwardly extendable, the internal support shoulder of the leg support member supportingly engages the external support shoulder of the leg pivot member to support the leg pivot member in the bottom end of the center column.

5. A foldable table, comprising:

a center column comprising:

a tube having a top end and a bottom end;

a leg support member attached to the bottom end of the tube having an internal support shoulder and a support rim; and a leaf support member connected to the top end of the tube having a plurality of equally spaced radial fingers formed along the periphery thereof such that a plurality of radial slots are defined therebetween;

leg means for vertically supporting the center column, the leg means comprising:

a leg pivot member slidably disposed in the center column having an external support shoulder; and at least three legs pivotally attached to the leg pivot member such that the legs are selectively retractable into the center column and outwardly extendable so as to be engagable against the support rim, the internal support shoulder of the leg support member supportingly engages the external support shoulder of the leg pivot member to support the leg pivot member when the legs are outwardly extended;

a plurality of leaf members including a plurality of supporting leaf members equally spaced about the leaf support member and a plurality of regular leaf members position therebetween, each leaf member comprising:

a segmental portion having a pair of arcuate longitudinal edges; and a support rib integrally formed along the bottom side of the segmental portion having a wedge-shaped end portion pivotally secured in one of the radial slots of the leaf support member so as to permit movement of the leaf member between a open position wherein the segmental portions of the leaf members mate to form a horizontal planar surface and a closed position wherein the leaf members slidably overlap one another;

wherein the radial slots of the center leaf support are configured to matingly receive the wedge-shaped end portion of the support ribs when the leaf members are in either one of the open position and the closed position so as to maintain the leaf members in a designated radial plane, and wherein the rib portion of the supporting leaf members is provided with an enlarged distal end portion having a pair of hinge pin receiving holes longitudinally disposed therethrough;

hinged bracket means having a first end pivotally connected to the support leaf members and a second end pivotally connected to the tube for supporting the support leaf members in the open position;

beam hinge means for horizontally supporting the regular leaf members in the open position, the beam hinge means comprising:

a plurality of beam hinges each having oppositely disposed ends pivotally attached to adjacent supporting leaf members; and a plurality of L-shaped hinge pins each having a first hinge portion pivotally connected at one of the ends of the beam hinge and a second hinge portion pivotally disposed through one of the hinge pin receiving holes of the supporting leaf members such that the beam hinges are pivotally attached to adjacent supporting leaf members so that the ends of the beam hinges are rotatable about perpendicular axes as the supporting leaf members are moved to and from the open position; and a cap member mounted on the leaf support member and adapted to mate with the leaf members when same are in the open position so as to cooperate with the hinged bracket means and the hinged beam means to lock the leaf members in a horizontal planar position.

6. The foldable table of claim 5 wherein the support ribs of the leaf members are provided with an arcuate surface along the base thereof mateable with the oppositely disposed arcuate edge of the adjacent leaf member so that the leaf members nest against one another when in the closed position.

7. The foldable table of claim 6 wherein the center leaf support is provided with a retaining ring receiving groove about the periphery thereof having terminal ends and the wedge-shaped end portion of the support ribs has a hooked portion, and wherein the foldable table further comprises:

a split retaining ring disposable within the retaining ring receiving groove so that the hooked portion of the support ribs is pivotally supported within the radial slots on the retaining ring.

8. The foldable table of claim 7 wherein the hooked portion of the support ribs is tapered to facilitate pivotation of the leaf members between the open position and the closed position.

9. The foldable table of claim 8 wherein the tube includes an outer tube and an inner tube in a telescoping relationship, and wherein the foldable table further comprises:

plunger means for supporting the outer tube in a selected extended position relative to the inner tube.

10. The foldable table of claim 9 further comprising:

a cylindrical stool adapted to receive the foldable table when the leaf members are in the closed position.

11. The foldable table of claim 9 further comprising a plurality of cylindrical stools adapted to be nested with each other such that the foldable table is removably positioned within the innermost stool when the leaf members are in the closed position.

12. A foldable table, comprising:

a center column comprising:

a pair of telescoping tubes including an outer tube and an inner tube, each having a top end and a bottom end;

plunger means for supporting the outer tube in a selected extended position relative to the inner tube;

a leg support member attached to the bottom end of the tube having an internal support shoulder and a support rim; and a leaf support member connected to the top end of the tube having a plurality of equally spaced radial fingers formed along the periphery thereof such that a plurality of radial slots are defined therebetween;

leg means for vertically supporting the center column, the leg means comprising:

a leg pivot member slidably disposed in the center column having an external support shoulder; and at least three legs pivotally attached to the leg pivot member such that the legs are selectively retractable into the center column and outwardly extendable so as to be engagable against the support rim, the internal support shoulder of the leg support member supportingly engages the external support shoulder of the leg pivot member to support the leg pivot member when the legs are outwardly extended;

a plurality of leaf members including a plurality of supporting leaf members equally spaced about the leaf support member and a plurality of regular leaf members position therebetween, each leaf member comprising:

a segmental portion having a pair of arcuate longitudinal edges; and a support rib integrally formed along the bottom side of the segmental portion having an arcuate surface along the base thereof and a wedge-shaped end portion pivotally secured in one of the radial slots of the leaf support member so as to permit movement of the leaf member between an open position wherein the segmental portions of the leaf members mate to form a horizontal planar surface and a closed position wherein the leaf members slidably overlap, and nest against, one another;

wherein the radial slots of the center leaf support are configured to matingly receive the wedge-shaped end portion of the support ribs when the leaf members are in either one of the open position and the closed position so as to maintain the leaf members in a designated radial plane, and wherein the rib portion of the supporting leaf members is provided with an enlarged distal end portion having a pair of hinge pin receiving holes longitudinally disposed therethrough;

hinged bracket means having a first end pivotally connected to the support leaf members and a second end pivotally connected to the outer tube for supporting the support leaf members in the open position;

beam hinge means for horizontally supporting the regular leaf members in the open position, the beam hinge means comprising:

a plurality of beam hinges each having oppositely disposed ends pivotally attached to adjacent supporting leaf members; and a plurality of L-shaped hinge pins each having a first hinge portion pivotally connected at one of the ends of the beam hinge and a second hinge portion pivotally disposed through one of the hinge pin receiving holes of the supporting leaf members such that the beam hinges are pivotally attached to adjacent supporting leaf members so that the ends of the beam hinges are rotatable about perpendicular axes as the supporting leaf members are moved to and from the open position; and a cap member mounted on the leaf support member and adapted to mate with the leaf members when same are in the open position so as to cooperate with the hinged bracket means and the hinged beam means to lock the leaf members in a horizontal planar position.

13. The foldable table of claim 12 wherein the center leaf support is provided with a retaining ring receiving groove about the periphery thereof having terminal ends and the wedge-shaped end portion of the support ribs has a hooked portion, and wherein the foldable table further comprises:

a split retaining ring disposable within the retaining ring receiving groove so that the hooked portion of the support ribs is pivotally supported within the radial slots on the retaining ring.

14. The foldable table of claim 13 wherein the hooked portion of the support ribs is tapered to facilitate pivotation of the leaf members between the open position and the closed position.

15. The foldable table of claim 14 further comprising:

a cylindrical stool adapted to receive the foldable table when the leaf members are in the closed position.

16. The foldable table of claim 14 further comprising a plurality of cylindrical stools adapted to be nested with each other such that the foldable table is removably positioned within the innermost stool when the leaf members are in the closed position.

* * * * *

UNITED STATES PATENT AND TRADEMARK OFFICE

CERTIFICATE OF CORRECTION

PATENT NO. : 5,425,315

DATED : June 20, 1995

INVENTOR(S) : George M. Huggins

It is certified that error appears in the above-indentified patent and that said Letters Patent is hereby corrected as shown below:

Column 2, line 55, delete "construted" and substitute therefor --constructed--;

Column 8, line 12, after "which" insert --is--;

Column 9, line 32, delete "member" and substitute therefor --members--;

Column 9, line 49, delete "member" and substitute therefor --members--;

Column 9, line 59, after "from" insert --the--; and

Column 9, line 66, after "position" delete "," and substitute therefor --.--.

Signed and Sealed this

Fourteenth Day of November, 1995

Bruce Lehman

*Attest:*

BRUCE LEHMAN

*Attesting Officer*

*Commissioner of Patents and Trademarks*